US008899727B2

(12) United States Patent
Owaki et al.

(10) Patent No.: US 8,899,727 B2
(45) Date of Patent: Dec. 2, 2014

(54) LIQUID EJECTING HEAD AND LIQUID EJECTING APPARATUS

(71) Applicant: Seiko Epson Corporation, Tokyo (JP)

(72) Inventors: Hiroshige Owaki, Okaya (JP); Katsuhiro Okubo, Azumino (JP); Haruhisa Uezawa, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 13/756,868

(22) Filed: Feb. 1, 2013

(65) Prior Publication Data

US 2013/0201248 A1 Aug. 8, 2013

(30) Foreign Application Priority Data

Feb. 3, 2012 (JP) ..... 2012-022548
Oct. 15, 2012 (JP) ..... 2012-227706

(51) Int. Cl.

*B41J 2/05* (2006.01)
*B41J 29/393* (2006.01)
*B41J 2/125* (2006.01)
*B41J 2/14* (2006.01)

(52) U.S. Cl.

CPC ..... *B41J 2/125* (2013.01); *B41J 2002/14362* (2013.01); *B41J 2/14201* (2013.01); *B41J 2202/08* (2013.01); *B41J 2/14145* (2013.01); *B41J 2/14024* (2013.01); *B41J 2/14153* (2013.01); *B41J 2002/14419* (2013.01)

USPC ..... 347/65; 347/19

(58) Field of Classification Search

CPC ..... B41J 2/0454; B41J 2/04563
See application file for complete search history.

(56) References Cited

U.S. PATENT DOCUMENTS

2011/0242164 A1* 10/2011 Miura et al. ..... 347/9
2011/0249050 A1* 10/2011 Ozawa et al. ..... 347/10
2012/0092408 A1* 4/2012 Yamamori et al. ..... 347/17

FOREIGN PATENT DOCUMENTS

JP 06-031934 2/1994
JP 2009-056669 3/2009

* cited by examiner

*Primary Examiner* — Matthew Luu
*Assistant Examiner* — Renee I Wilson
(74) *Attorney, Agent, or Firm* — Harness, Dickey & Pierce, P.L.C.

(57) ABSTRACT

A liquid ejecting head includes a head body configured to eject liquid, a flow path member including a liquid flow path for supplying the liquid to the head body, and a circuit substrate held by the flow path member and including a temperature detection unit configured to detect a temperature. The flow path member includes a detection region, which has a thermal resistance lower than a thermal resistance of other regions and which is provided in a part of a partition wall that partitions the liquid flow path. The circuit substrate is fixed to the flow path member in a state in which the temperature detection unit faces the detection region.

14 Claims, 10 Drawing Sheets

LIQUID EJECTING HEAD AND LIQUID EJECTING APPARATUS

BACKGROUND

1. Technical Field

The present invention relates to a liquid ejecting head and a liquid ejecting apparatus configured to eject liquid from nozzle openings. In particular, the invention relates to an ink jet type recording head and an ink jet type recording apparatus configured to discharge an ink as the liquid.

2. Related Art

Liquid ejecting apparatuses, typified by an ink jet type recording apparatus such as an ink jet type printer or plotter, include a liquid ejecting head capable of discharging liquid from a liquid storage portion, such as a cartridge or a tank that stores the liquid, as droplets.

Such a liquid ejecting head includes a pressure generation chamber, which communicates with nozzle openings and a pressure generation unit, which changes the pressure of the liquid contained in the pressure generation chamber to discharge liquid droplets from the nozzle openings. For the pressure generation unit installed in the liquid ejecting head, a longitudinal vibration type piezoelectric element, a deflection vibration type piezoelectric element, a heater element, or an element that uses electrostatic force, for example, are used.

The liquid discharged from the liquid ejecting head described above has a viscosity of an appropriate level for discharging, which is determined according to the type of the liquid. The viscosity of the liquid is related to the temperature of the liquid. To paraphrase this, the viscosity rises as the temperature falls and falls as the temperature rises. Therefore, it is necessary to correct a drive signal for driving the pressure generation unit of the liquid ejecting head in accordance with the viscosity that has changed in accordance with the temperature of the liquid. For example, refer to JP-A-6-31934 and JP-A-2009-56669.

However, because the measurement of the liquid temperature is carried out by measuring the external environment outside the liquid ejecting head (i.e., the ambient temperature) by using a temperature sensor, an error may occur in the case where there is a difference between the temperature of the liquid stored in the liquid ejecting head immediately before ejection and the environmental temperature. Accordingly, if the drive signal is corrected on the basis of the environmental temperature, the drive signal will not be corrected to be a drive signal that is optimal for the actual viscosity of the liquid. As a result, the discharge performance may be degraded and the print quality may be degraded.

In addition, a temperature sensor may be arranged in a flow path of the liquid ejecting head but it is difficult to provide such a temperature sensor in the flow path because liquid ejecting heads have become more densely arranged and smaller. In addition, providing a temperature sensor in the flow path may result in an increase in the size of the liquid ejecting head and an increase in the manufacturing cost. Furthermore, it is necessary to insulate the temperature sensor to be provided in the flow path. The insulated temperature sensor may become large. Accordingly, the large temperature sensor cannot be arranged in the flow path. In addition, wiring for connecting the sensor to the outside of the flow path becomes necessary. As a result, a problem that a complex structure is required may arise.

SUMMARY

An advantage of some aspects of the invention is that a liquid ejecting head and a liquid ejecting apparatus which are small and capable of detecting a temperature near the liquid to be discharged, executing optimal control for the liquid to be discharged, and thus improving the discharge performance.

According to an aspect of the invention, a liquid ejecting head includes a head body configured to eject liquid, a flow path member including a liquid flow path for supplying the liquid to the head body, and a circuit substrate held by the flow path member and including a temperature detection unit configured to detect a temperature. The flow path member includes a detection region, which has a thermal resistance lower than a thermal resistance of other regions and which is provided in a part of a partition wall that partitions the liquid flow path. The circuit substrate is fixed to the flow path member in a state in which the temperature detection unit faces the detection region. In the present aspect, because the actual temperature of the liquid in the liquid flow path can be measured with a small error compared to a case of measuring the outdoor temperature, a pressure generation unit is allowed to execute a drive that is optimal for the temperature of the liquid to be discharged. Accordingly, the print quality can be improved by improving the liquid discharge performance. In addition, the size of the liquid ejecting head can be prevented from becoming large, a complicated configuration is not required, and costs can be reduced compared to a case of providing a temperature sensor in the flow path.

It is preferable, in the liquid ejecting head according to the aspect, that the flow path member include a retaining hole which communicates with the liquid flow path and which penetrates to a side of the circuit substrate, that the retaining hole be sealed by a sealing member having a thermal conductivity higher than a thermal conductivity of the flow path member, and a region in which the sealing member seals the retaining hole be the detection region. In the present aspect, costs can be reduced because the detection region having the low thermal resistance can be easily formed by using the sealing member having the high thermal conductivity without changing the material for the flow path member.

It is preferable, in the liquid ejecting head according to the aspect, that the detection region be provided downstream of a filter chamber including a filter. In the present aspect, the error between the temperature of the liquid to be actually discharged and measured temperature information can be reduced by detecting the temperature of a region closer to the liquid to be supplied to the head body.

It is preferable, in the liquid ejecting head according to the aspect, that the detection region be provided upstream of the filter chamber including the filter. In the present aspect, if any foreign matter, such as an adhesive used in forming the detection region has been mixed into the liquid, the contaminant can be captured by the filter. Accordingly, poor discharge can be prevented.

It is preferable, in the liquid ejecting head according to the aspect, that the temperature detection unit and the detection region be connected via fluid and that the fluid be a filler having a thermal conductivity higher than a thermal conductivity of gas. In the present aspect, by using a material having the high thermal conductivity as the fluid, the temperature of the detection region can be measured by the temperature detection unit with a high accuracy and responsiveness.

It is preferable, in the liquid ejecting head according to the aspect, that the temperature detection unit and the detection region directly contact each other. In the present aspect, the temperature of the detection region can be measured by the temperature detection unit with a high accuracy and responsiveness.

It is preferable, in the liquid ejecting head according to the aspect, that the circuit substrate be fixed in a state in which the circuit substrate is pressed toward the detection region.

In the present aspect, variation in the accuracy of measurement by the temperature detection unit can be suppressed because the fixed state of the circuit substrate can be maintained in the state in which the temperature detection unit of the circuit substrate and the detection region are closest to each other, which results in enabling the temperature measurement with a high accuracy.

According to another aspect of the invention, a liquid ejecting apparatus includes the liquid ejecting head according to the above-described aspect. In the present aspect, a small-size liquid ejecting apparatus capable of improving the print quality can be implemented.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinbelow, the invention will be described with reference to an exemplary embodiment of the invention.

First Exemplary Embodiment

Figure 1:
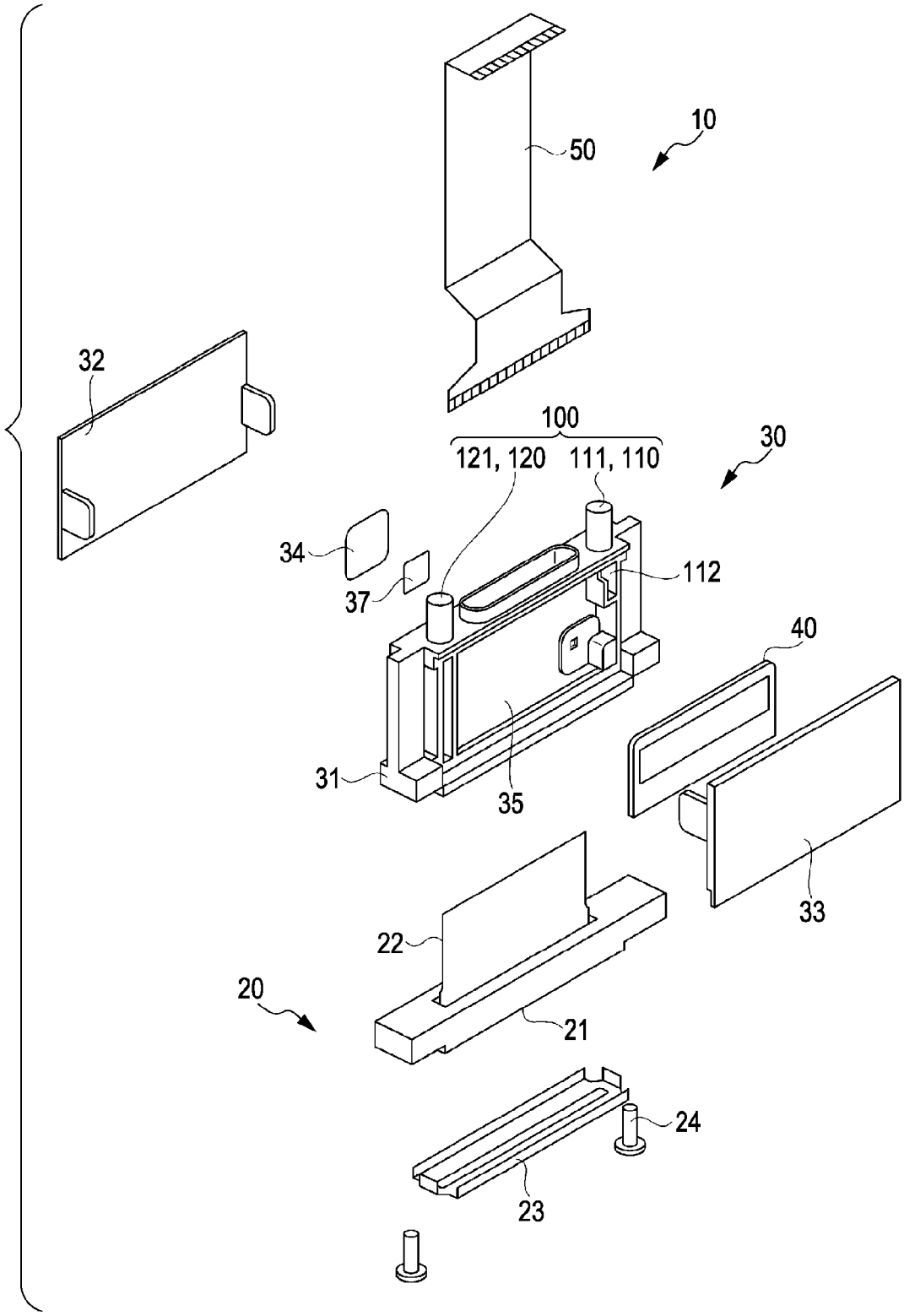
FIG. 1 is an exploded perspective view exploded perspective view illustrating a recording head according to a first exemplary embodiment.
Figure 2:
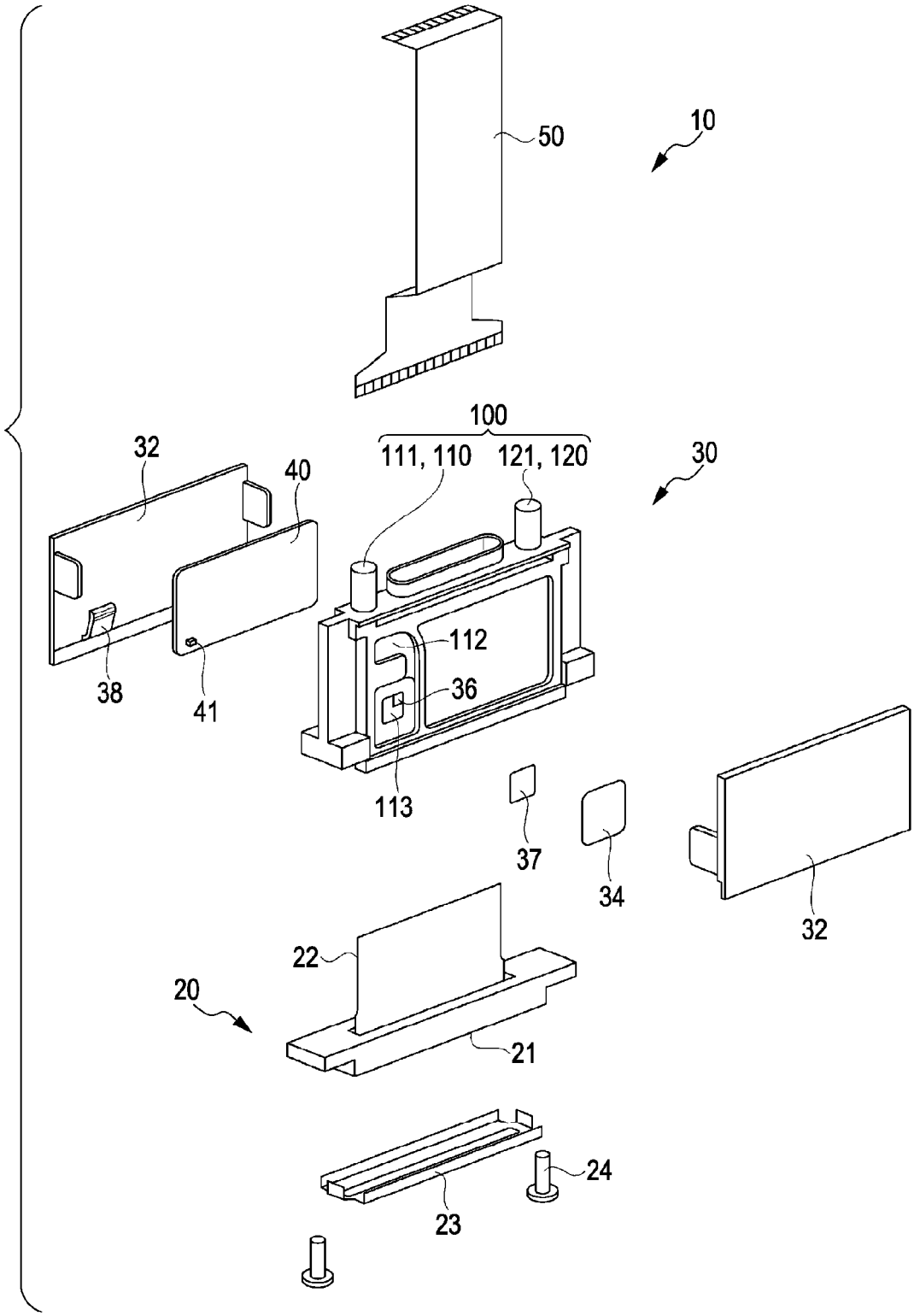
FIG. 2 is an exploded perspective view illustrating the recording head according to the first exemplary embodiment.
Figure 3A:
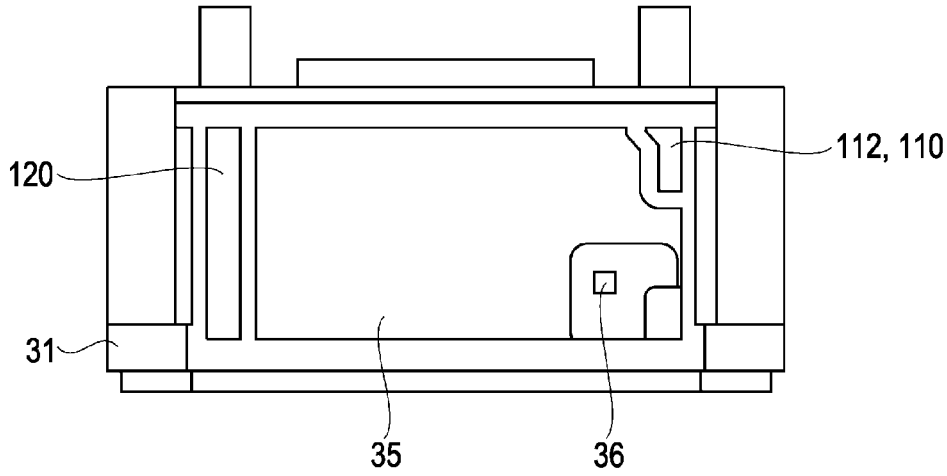
FIGS. 3A and 3B are plan views illustrating a flow path member body according to the first exemplary embodiment.
Figure 3B:
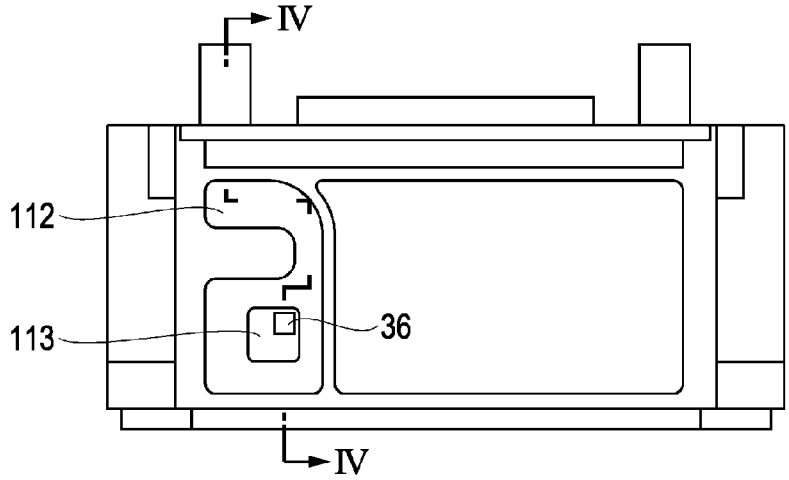
Figure 4:
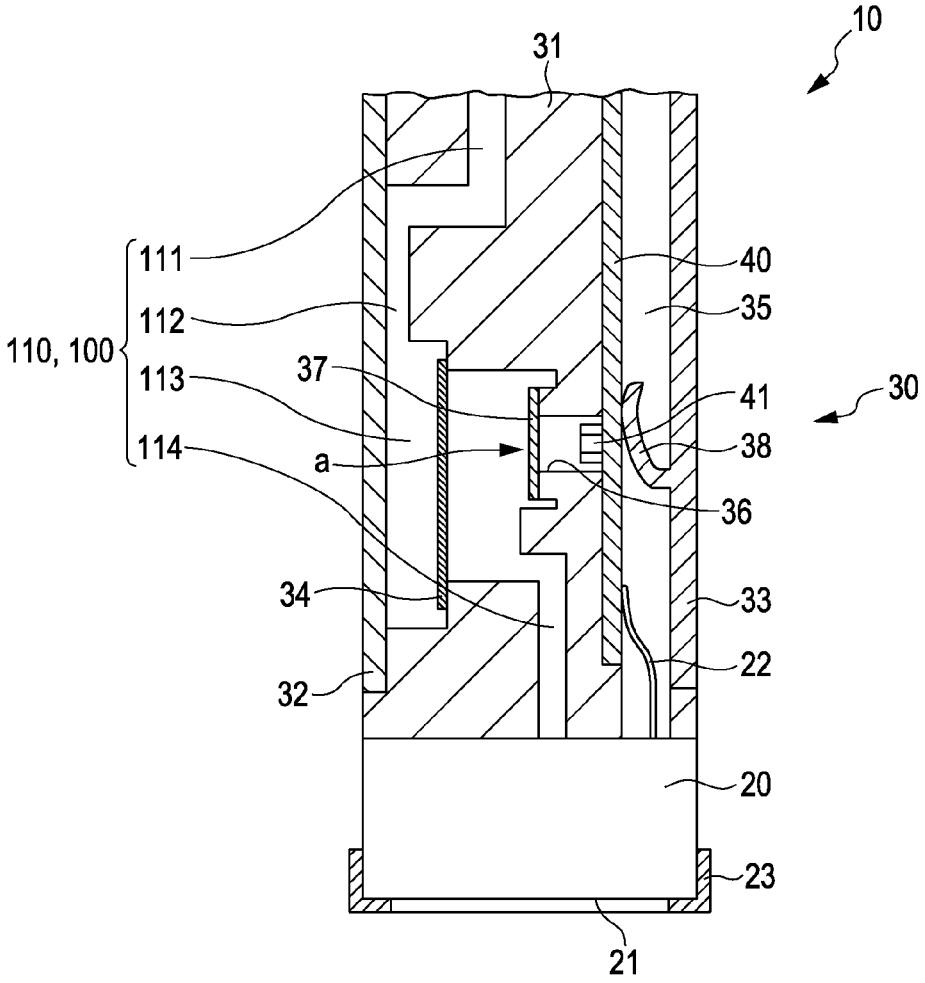
FIG. 4 is a cross section illustrating main components of the recording head according to the first exemplary embodiment.

FIGS. 1 and 2 are exploded perspective views each illustrating a liquid ejecting head, which is an example of an ink jet type recording head according to the first exemplary embodiment of the invention. FIGS. 3A and 3B are plan views illustrating a flow path member body. FIG. 4 is a cross section illustrating main components of the ink jet type recording head illustrated in FIG. 3B along section IV-IV.

As is illustrated in the drawings, an ink jet type recording head 10, which is an example of a liquid ejecting head according to the present exemplary embodiment, includes a head body 20, which is configured to discharge ink droplets as liquid, a flow path member 30, which is configured to supply the ink to the head body 20, a circuit substrate 40 held by the flow path member 30, and a wiring substrate 50, which is connected to the circuit substrate.

The head body 20 is provided with a liquid ejecting surface 21 on one side thereof, on which nozzle openings (not illustrated) for discharging ink droplets as the liquid open. In addition, on its inside (not illustrated), the head body 20 is provided with a flow path that communicates with the nozzle opening and a pressure generation unit configured to change the pressure of the ink existing in the flow path. For such a pressure generation unit, a device can be used which discharges ink droplets from nozzle openings by changing the pressure of the ink existing in a flow path by changing the volume of the flow path, which can be executed by causing a piezoelectric actuator having a piezoelectric material including an electromechanical transducing function to deform. In addition, for the pressure generation unit described above, a device can be used which includes a heater element located in a flow path and which discharges ink droplets from nozzle openings by using bubbles generated due to the heat generated by the heater element. Furthermore, a device known as an electrostatic actuator, which discharges ink droplets from nozzle openings by deforming a diaphragm by an electrostatic force generated between the diaphragm and electrodes, and the like can be used for the above-described pressure generation unit.

In addition, the head body 20 includes the drive wiring 22, one end of the drive wiring 22 being a flexible wiring member connected to the pressure generation unit. The drive wiring 22 can be provided with a drive circuit (a drive integrated circuit (IC)) for driving the pressure generation unit. To paraphrase this, the drive wiring 22 can be a chip-on-film (COF) substrate on which a drive circuit is mounted.

On the side of the liquid ejecting surface 21 of the head body 20 described above, on which the nozzle openings open, a cover head 23 configured to protect the nozzle openings in a state in which they are exposed is fixed.

In addition, the flow path member 30, which supplies the ink to the above-described head body 20 as the liquid, is provided with a flow path member body 31 and a first lid member 32 and a second lid member 33, which are provided to the flow path member body 31 respectively on the two sides of the flow path member body 31.

Furthermore, the flow path member 30 is provided with a liquid flow path 100, which is configured to supply the ink from a liquid storage portion (not illustrated) that stores the ink as the liquid to the head body 20 and configured to collect the ink from the head body 20 in the liquid storage portion. More specifically, the flow path member 30 is provided with a supply flow path 110, one end of the flow path member 30 being connected to the liquid storage portion directly or via a tube or the like and the other end of the flow path member 30 being connected to the head body, and a collection flow path 120. In the present exemplary embodiment, the supply flow path 110 is a forward flow path for supplying the ink from the liquid storage portion to the head body and the collection flow path 120 includes a discharge port 121 and is a return flow path for collecting the ink from the head body to the liquid storage portion.

The supply flow path 110 is provided with an ink introduction port 111, which is connected to the liquid storage portion directly or via a tube or the like, a first flow path 112 that communicates with the ink introduction port 111, a filter chamber 113, which is connected to the first flow path 112, and a second flow path 114 for connecting the filter chamber 113 and the head body 20.

The first flow path 112 and the filter chamber 113 are provided on the flow path member body 31 in groove-like shapes that open on the side thereof (the side facing the first lid member 32) and are partitioned by the first lid member 32 by sealing the opening.

In addition, the second flow path 114 is formed so that one end thereof communicates with the filter chamber 113 and the other end thereof is connected to the flow path of the head body 20.

Furthermore, the filter chamber 113 is provided with a filter 34 configured to remove foreign matter, such as dust or bubbles contained in the ink.

The filter 34 is configured to remove foreign matter such as dust or bubbles contained in the ink, which is a liquid. For the filter 34, a filter having a sheet-like shape and a plurality of micropores formed by finely weaving metal fibers, resin fibers, or the like, a filter constituted by a plate-like metal member, a plate-like resin member, or the like having a plurality of micropores formed thereon, or the like can be used. Note that a nonwoven fabric can be used as the filter 34. To paraphrase this, the material of the filter 34 is not limited to a specific material.

In addition, the flow path member body 31 includes a recessed portion 35, which opens toward the opposite side of the first lid member 32 to which the first flow path 112 and the filter chamber 113 open. The circuit substrate 40 is inserted into the recessed portion 35 of the flow path member body 31. In addition, the circuit substrate 40 inserted into the recessed portion 35 is held between the second lid member 33, which seals the flow path member body 31 and the opening of the recessed portion 35.

Furthermore, the flow path member body 31 is provided with a retaining hole 36, which communicates with the supply flow path 110 that is the liquid flow path 100 and formed so as to penetrate through the flow path member body 31 to the side of the circuit substrate 40. In the present exemplary embodiment, the retaining hole 36 is provided in a region facing the filter 34 on the side of the filter chamber 113 with which the second flow path 114 communicates. In other words, the retaining hole 36 is provided on the wall surface of the filter chamber 113 so as to penetrate through the filter chamber 113 and the recessed portion 35. One opening of the retaining hole 36 is provided so as to face the opening and the filter 34 and the other opening of the retaining hole 36 is provided so as to face the circuit substrate 40.

In addition, the retaining hole 36 is sealed by a sealing member 37. In the present exemplary embodiment, the sealing member 37 is constituted by a plate-like member and is fixed on the opening surface of the retaining hole 36 on the side of the filter chamber 113.

For the sealing member 37 described above, a material having a thermal conductivity higher than that of the flow path member body 31 can be used. For example, if the flow path member body 31 is formed by using a resin material, a metallic material can be used for the sealing member 37. Note that the thermal conductivity of metals is greater than that of resins approximately by two orders of magnitude. As described above, by using the sealing member 37 having a high thermal conductivity, the region in which the sealing member 37 seals the retaining hole 36 can be defined as a detection region a whose thermal resistance is lower than that of the remainder of the supply flow path 110 that is the liquid flow path 100. In other words, the flow path member 30 is provided with the detection region a having a thermal resistance lower than that of the remainder of the flow path member 30 (a partition wall partitioned by the flow path member body 31) in a part of the partition wall which partitions the liquid flow path 100 (the supply flow path 110). Note that the thermal resistance referred to herein denotes the magnitude of the force for preventing the outflow of heat from a substance. The thermal resistance is expressed by the following expression:

$$\text{Thermal resistance} = \text{thickness}/(\text{thermal conductivity} \times \text{area}).$$

In addition, because the opening on the opposite side of the opening of the retaining hole 36 sealed by the sealing member 37 is provided so that the opening on the opposite side opens toward the circuit substrate 40 so as to face the circuit substrate 40, the detection region a is provided so as to face the circuit substrate 40.

The circuit substrate 40 is constituted by a printed wiring board on which electronic components and wiring (not illustrated) are mounted. Drive wiring for the head body 20 and the wiring substrate 50 are electrically connected to the circuit substrate 40 described above. With the above-described configuration, a print signal from an external control circuit and the like is supplied to the pressure generation unit via the wiring substrate 50, the circuit substrate 40, and the drive wiring 22 as a drive signal. In addition, a signal from the circuit substrate 40 (i.e., temperature information to be described below) is transmitted to the external control circuit and the like via the wiring substrate 50. The circuit substrate 40 described above can be constituted by either a flexible substrate or a rigid substrate or by a composite substrate, which is a combination of a flexible substrate or a rigid substrate. In the present exemplary embodiment, by using a rigid substrate for the circuit substrate 40, a temperature detection unit included in the circuit substrate 40, which will be described in detail below, can be easily fixed in place.

Furthermore, the circuit substrate 40 is provided with a temperature detection unit 41, which is provided in a region in which the circuit substrate 40 faces the retaining hole 36 (the detection region a). For the temperature detection unit 41, a thermistor, a digital temperature sensor, and the like can be used.

If a thermistor is used as the temperature detection unit 41, the area of the opening of the retaining hole 36 (the detection region a) can be designed to be small and costs can be reduced because thermistors are relatively small and inexpensive. On the other hand, if a digital temperature sensor is used as the temperature detection unit 41, the temperature can be detected with a high accuracy because a digital temperature sensor is highly noise-resistant due to a temperature measuring device and a temperature measuring circuit packaged in the sensor although the size of the temperature detection unit 41 may become larger than the case of using a thermistor.

The above-described circuit substrate 40 is pinched between the flow path member body 31 and the second lid member 33 in the recessed portion 35 of the flow path member body 31. In addition, the second lid member 33 is provided with a pressing portion 38, which is configured to press a region in which the temperature detection unit 41 is provided, i.e., a region in the surface opposite to the surface on which the temperature detection unit 41 of the circuit substrate 40 is provided, and a periphery thereof toward the inside of the retaining hole 36 (the detection region a). In the present exemplary embodiment, the pressing unit 38 includes a plate spring the one end of which is fixed onto the second lid member 33 and the other end of which is a free end and is configured so that the free end of the plate spring comes into contact with the region corresponding to the temperature detection unit 41 arranged on the side of the surface opposite to that on which the temperature detection unit 41 of the circuit substrate 40 is arranged. With the above-described configuration, the circuit substrate 40 is held by the flow path member 30 on the side of the sealing member 37, i.e., in a state in which the sealing member 37 is pressed against the detection region a.

The head body 20 is fixed to the above-described flow path member 30 by using two screw members 24 screwed into the flow path member 30. As described above, the flow path member 30 and the head body 20 are integrated to constitute the ink jet type recording head 10.

The ink jet type recording head 10 having the above-described configuration takes the ink from the liquid storage portion (not illustrated) into the flow path provided inside the head body 20 via the supply flow path 110 of the flow path member 30 to fill the inside of the flow path until the ink reaches the nozzle opening (not illustrated), and consequently, discharges ink droplets from the nozzle openings by driving the pressure generation unit in accordance with a recording signal from the drive circuit or the like. In addition, the ink introduced into the flow path provided inside the head body 20 is returned to the liquid storage portion via the collection flow path 120 of the flow path member 30. More specifically, the ink jet type recording head 10 executes an operation known as circulation, by which the ink is supplied from the liquid storage portion to the inside of the head body 20 via the supply flow path 110 and then is collected by the liquid storage portion from the inside of the head body 20 via the collection flow path 120.

Furthermore, the ink jet type recording head 10 described above measures the temperature of the ink in the supply flow path 110 by using the temperature detection unit provided on the circuit substrate 40. In this configuration, because the temperature detection unit 41 is provided near the detection region a having a thermal resistance lower than that of other regions of the partition wall partitioning the supply flow path 110, the temperature detection unit 41 can measure the temperature close to the actual temperature of the ink in the supply flow path 110 with a high accuracy and high responsiveness (i.e., with a high speed of response to an abrupt change in ink temperature). Accordingly, the actual temperature of the ink in the liquid flow path 100 immediately before the ink is discharged from the head body 20 can be measured with a high accuracy, i.e., with only a small error. With the above-described configuration, by correcting the drive signal for driving the pressure generation unit in accordance with the temperature information measured by the temperature detection unit 41, driving that is optimal for the actual temperature (viscosity) of the ink is executed to improve the ink droplet discharge performance. As a result, the print quality can be improved. In particular, in the present exemplary embodiment, the temperature of the ink immediately before being supplied to the head body 20 (i.e., immediately before being discharged from the head body 20) can be detected because the detection region a is provided on the side of the filter chamber 113 to which the second flow path 114 communicates. With the above-described configuration, the present exemplary embodiment can suppress the error between the temperature of the ink to be discharged and the temperature measured by the temperature detection unit 41 to be relatively small and execute driving that is optimal for the ink to be discharged by using the pressure generation unit to improve the ink droplet discharge performance. Thus, the print quality can be improved.

Note that if the temperature detection unit 41 is provided near a region other than the detection region a of the flow path member 30, the actual temperature of the ink in the supply flow path 110 cannot be detected because the thermal resistance of the flow path member body 31 is high. As a result, the discharge performance may be degraded because an error may occur in the case where there is a difference between the temperature of the ink immediately before being discharged from the head body 20 and the temperature detected by the temperature detection unit 41 even if the drive signal is corrected according to the temperature information measured by the temperature detection unit 41. If the temperature of the ink changes abruptly in a short period of time, in particular, the pressure generation unit cannot be driven according to the drive signal that is optimal for the actual temperature of the ink unless the temperature detection unit 41 can measure the actual temperature of the ink.

In the present exemplary embodiment, even if the temperature of the ink that flows through the supply flow path 110 has been abruptly changed in a short period of time, the temperature of the ink can be transmitted to the temperature detection unit 41 with a high responsiveness due to the low thermal resistance of the detection area a implemented by the sealing member 37 having a high thermal conductivity. Accordingly, the change in the actual temperature of the ink can be measured with a high accuracy, i.e., with only a small error.

In addition, in the present exemplary embodiment, the circuit substrate 40 is fixed to the flow path member 30 in a state in which the circuit substrate 40 is pressed toward the sealing member 37. Accordingly, variation in the accuracy of measurement by the temperature detection unit 41, which may otherwise occur due to the movement of the circuit substrate 40 and the like, can be suppressed. In other words, the accuracy of measurement may vary because the distance between the temperature detection unit 41 and the sealing member 37 varies if the circuit substrate 40 deviates from its normal fixing position, which may occur when the ink jet type recording head 10 is moved or due to an impact applied to the ink jet type recording head 10. In the present exemplary embodiment, the circuit substrate 40 may not easily deviate from its fixing position because the circuit substrate 40 is fixed in a state in which the circuit substrate 40 is pressed toward the sealing member 37 (the detection area a). As a result, the measurement accuracy may not easily vary.

Note that although a configuration in which the temperature sensor can be provided in the flow path of the head body 20 can be used, the head body 20 may become large-sized if the temperature sensor is provided in the flow path of the head body 20. In particular, if the dimension of the head body 20 is large in the direction perpendicular to the direction of juxtaposed arrangement of the nozzle openings, when a plurality of ink jet type recording heads 10 are juxtaposed in the direction perpendicular to the direction of juxtaposed arrangement of the nozzle openings, a problem may arise such that the ink droplets from the juxtaposed ink jet type recording heads 10 may be placed on a recording medium at different impact timings. In addition, if the impact timings of the ink droplets discharged from the juxtaposed ink jet type recording heads 10 differ greatly from one another and if the same ink is discharged, the color tone may change due to the difference in the amount of ink that penetrates into the recording medium and due to the different drying timings. Furthermore, if an ink including a solvent or a high-performance ink, such as an ultraviolet (UV) curable type ink, is used, the color tone and the coverage may change and become inappropriate because the drying timings may be greatly different from one another.

In the present exemplary embodiment, the temperature detection unit 41 is provided on the flow path member 30 and the temperature detection unit 41 is provided in a region close to and facing the detection region a having a low thermal resistance instead of providing the temperature detection unit 41 inside the liquid flow path 100. With the above-described configuration, the size of the head body 20 can be prevented from becoming large. Accordingly, the present exemplary embodiment can suppress the impact of the ink droplets on the recording medium executed at different timings for the juxtaposed ink jet type recording heads 10 and can suppress any change of the color tone occurring due to different amounts of ink penetrated into the recording medium or different drying timings if the same ink is discharged. In addition, if an ink including a solvent or a high-performance ink, such as an ultraviolet (UV) curable type ink, is used, the present exemplary embodiment can suppress the change of the color tone and the coverage which may occur because the drying timings are greatly different from one another.

Note that in the present exemplary embodiment, the sealing member 37 is fixed on the opening surface of the retaining hole 36 on the side of the filter chamber 113. Accordingly, when the ink is supplied from the liquid storage portion to the supply flow path 110 by applying pressure thereto, the sealing member 37 is pressed toward the opening surface which is a fixed surface. Therefore, falling of the sealing member 37 off the flow path member body 31 can be suppressed. As a result, the leakage of ink toward the circuit substrate 40 can be suppressed.

Figure 5:
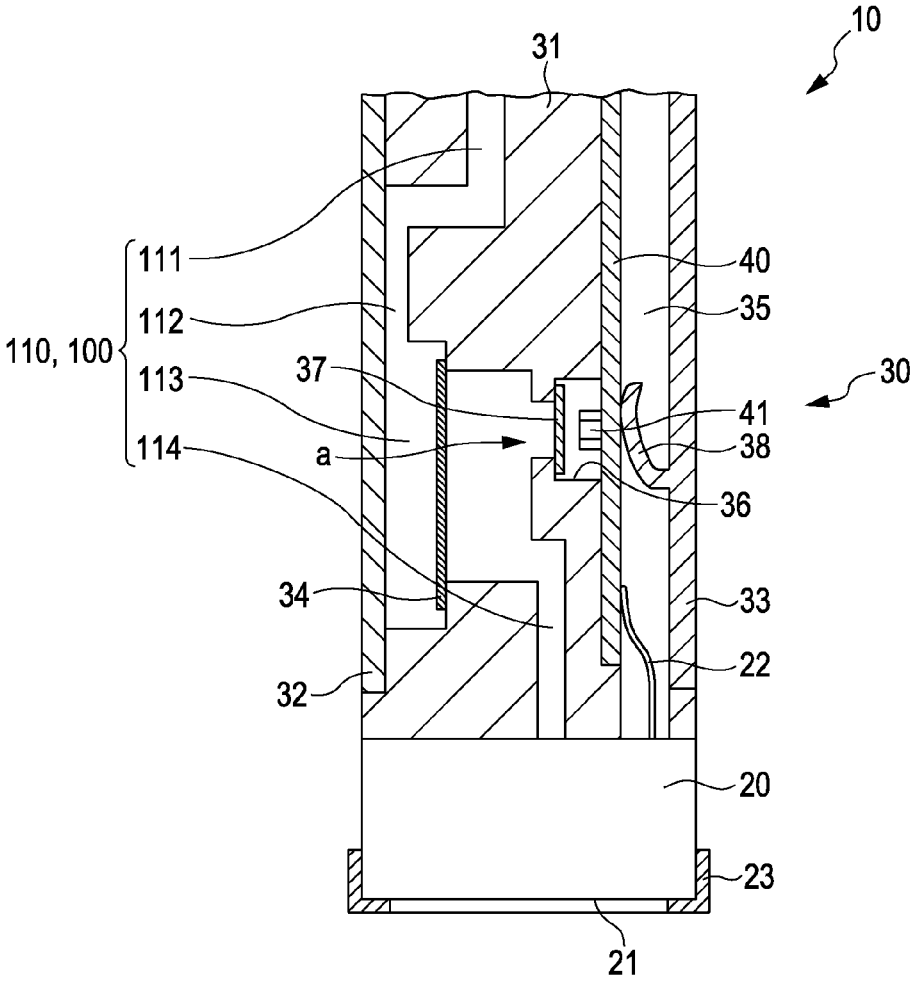
FIG. 5 is a cross section illustrating main components of the recording head according to a modification of the first exemplary embodiment.

Note that the method for mounting the sealing member 37 is not limited to this. FIG. 5 illustrates another example of the method for mounting the sealing member 37. Referring to FIG. 5, the sealing member 37 is fixed on the opening surface of the retaining hole 36 on the side of the circuit substrate 40. As described above, by fixing the sealing member 37 on the opening surface of the retaining hole 36 on the side of the circuit substrate 40, the sealing member 37 is pressed in the direction of falling off from the flow path member body 31 when the ink is pressed to be supplied from the liquid storage portion to the supply flow path 110. On the other hand, if the ink is supplied from the liquid storage portion to the supply flow path 110 by executing suction from the collection flow path 120, the sealing member 37 is hard to fall off from the flow path member body 31 because the sealing member 37 is suctioned toward the supply flow path 110. With the above-described configuration, the leakage of ink toward the circuit substrate 40 can be suppressed.

Second Exemplary Embodiment

Figure 6:
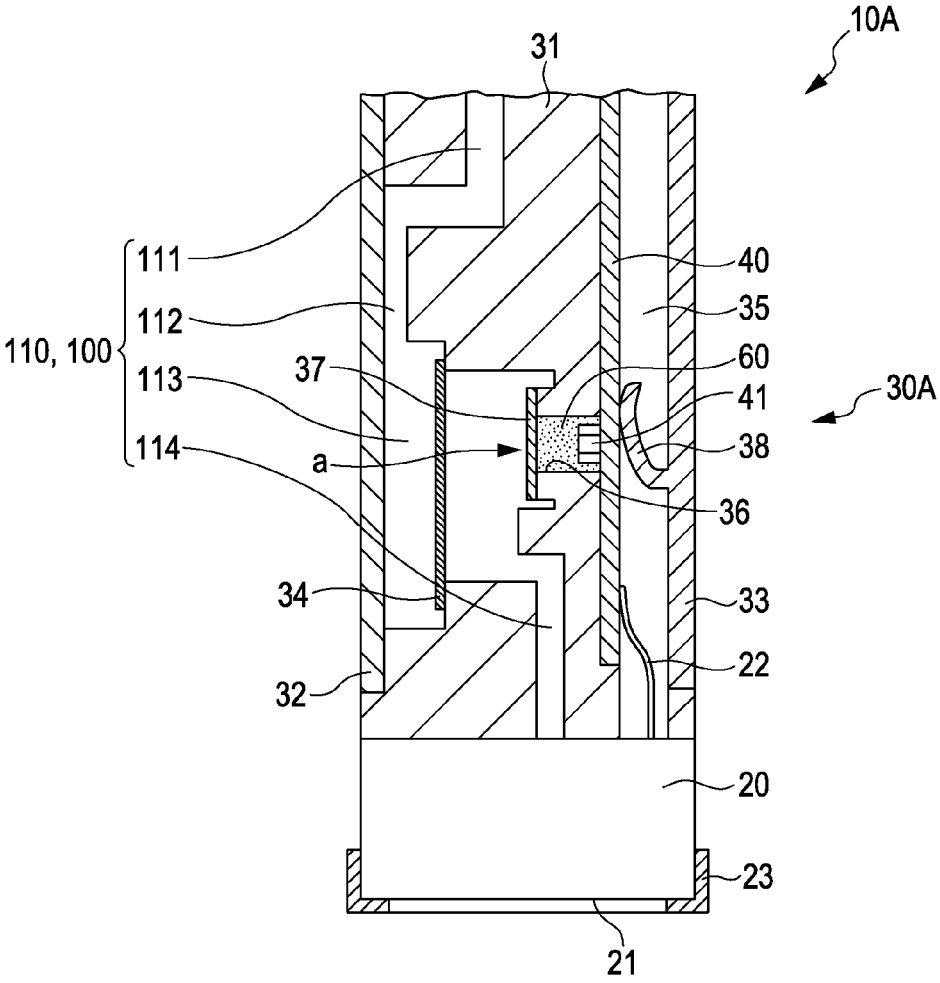
FIG. 6 is a cross section illustrating main components of the recording head according to a second exemplary embodiment.

FIG. 6 is a cross section illustrating main components of an ink jet type recording head, which is an example of a liquid ejecting head according to the second exemplary embodiment of the invention. Note that the same members as those of the above-described exemplary embodiment are provided with the same reference signs. Accordingly, the detailed description thereof will not be repeated here.

Referring to FIG. 6, an ink jet type recording head 10A according to the present exemplary embodiment includes the head body 20, a flow path member 30A, the circuit substrate 40, and the wiring substrate 50.

The flow path member 30A includes the flow path member body 31, the first lid member 32, and the second lid member 33. The circuit substrate 40 is held between the flow path member body 31 and the second lid member 33.

The flow path member 30A includes the supply flow path 110 and the collection flow path 120 as the liquid flow path 100. The supply flow path 110 includes the ink introduction port 111, the first flow path 112, the filter chamber 113 in which the filter 34 is provided, and the second flow path 114. In addition, the collection flow path 120 includes the discharge port 121.

In addition, the flow path member body 31 is provided with the retaining hole 36, which is a communication hole between the side of the filter chamber 113 that communicates with the second flow path 114 and the recessed portion 35. The retaining hole 36 is the detection region a having a low thermal resistance, which is sealed by the sealing member 37 having the thermal conductivity higher than that of the flow path member body 31.

In addition, the temperature detection unit 41 of the circuit substrate 40 is inserted into the retaining hole of the flow path member body 31 and the temperature detection unit 41 and the sealing member 37 (the detection region a) are arranged so as to face each other.

Moreover, in the present exemplary embodiment, the retaining hole 36 is charged with a filler 60, which is fluid having a thermal conductivity higher than that of gas (air) and the sealing member 37 (the detection region a) and the temperature detection unit 41 are connected via the filler 60.

The filler 60 is used to efficiently transmit the heat from the detection region a to the temperature detection unit 41. It is preferable to use the fluid having the thermal conductivity as high as possible. In addition, for the filler 60, it is necessary to use an insulating material that would not develop a short circuit in the wiring or damage the electronic components if the filler 60 has adhered to the surface of the circuit substrate 40. Furthermore, it is preferable that the filler 60 have a relatively high viscosity with which the leakage of the filler 60 to an outside of the retaining hole 36 (i.e., into the recessed portion 35) hardly occurs. For example, the filler 60 described above include grease made of a heat-conductive silicone resin and the like.

As described above, by using the filler 60 having the high thermal conductivity, the thermal resistance between the detection region a and the temperature detection unit 41 can be lowered.

Note that it is not necessary that the retaining hole 36 is entirely filled with the filler 60 as long as the filler 60 contacts both the sealing member 37 (the detection region a) and the temperature detection unit 41. However, unless the retaining hole 36 is entirely filled with the filler 60, the state of contact between the sealing member (the detection region a) and the temperature detection unit 41 may be lost due to any deformation or leakage of the filler 60. Therefore, it is preferable that the retaining hole 36 be entirely filled with the filler 60.

In addition, the circuit substrate 40 is fixed by the pressing unit 38, which is included in the second lid member 33, in a state in which the circuit substrate 40 is pressed against the sealing member 37. Accordingly, because the opening of the retaining hole 36, which is charged with the filler 60, on the side of the circuit substrate 40 is sealed in a state in which the opening is pressed by the circuit substrate 40 with a predetermined pressure, the leakage of the filler 60 from the retaining hole 36 to the outside (i.e., into the recessed portion 35) can be suppressed.

As described above, the filler 60 is charged into the retaining hole 36 and the sealing member 37 (the detection region a) and the temperature detection unit 41 are connected via the filler 60. With the above-described configuration, the heat of the ink in the supply flow path 110 can be easily transmitted to the temperature detection unit 41 via the sealing member 37 having the high thermal conductivity and the filler 60. As a result, the actual temperature of the ink that passes through the supply flow path 110 can be detected with a high accuracy. Furthermore, because the heat of the ink in the supply flow path 110 is transmitted to the temperature detection unit 41 via the sealing member 37 having the high thermal conductivity and the filler 60, the actual temperature of the ink can be measured by the temperature detection unit 41 with a high responsiveness. In other words, if the temperature of the ink that passes through the supply flow path 110 has abruptly changed in a short period of time, the abrupt change of the temperature can be detected by the temperature detection unit 41 in a short period of time. Accordingly, the piezoelectric actuator can instantaneously execute the drive for discharging the ink droplets appropriate for the temperature of the ink. With the above-described configuration, the ink jet type recording head 10A having a high ink discharge performance can be implemented.

Third Exemplary Embodiment

Figure 7A:
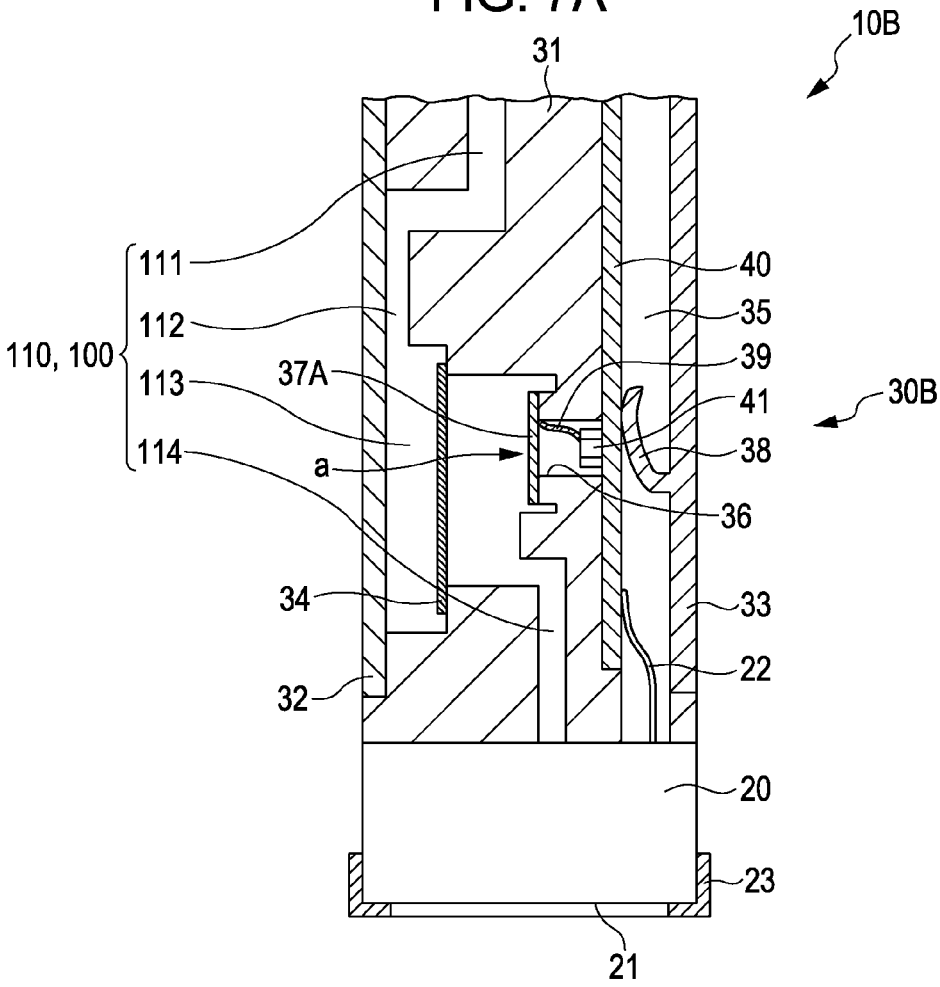
FIGS. 7A and 7B are cross sections illustrating main components of the recording head according to a third exemplary embodiment.
Figure 7B:
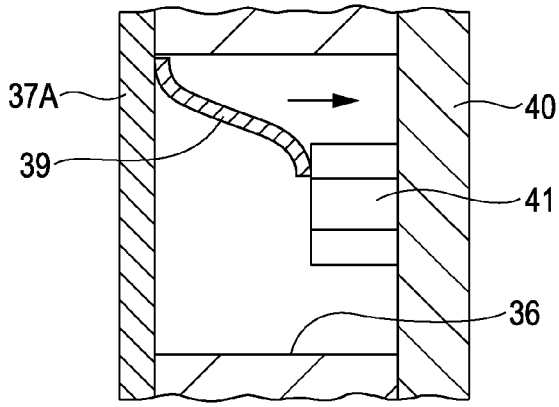

FIGS. 7A and 7B are cross sections illustrating main components of an ink jet type recording head, which is an example of a liquid ejecting head according to the third exemplary embodiment. Note that the same members as those of the exemplary embodiments described above are provided with the same reference signs. Accordingly, the detailed description thereof will not be repeated here.

Referring to FIG. 7A, an ink jet type recording head 10B according to the present exemplary embodiment includes the head body 20, a flow path member 30B, the circuit substrate 40, and the wiring substrate 50.

The flow path member 30B includes the flow path member body 31, the first lid member 32, and the second lid member 33. The circuit substrate 40 is held between the flow path member body 31 and the second lid member 33.

The flow path member 30B includes the supply flow path 110 and the collection flow path 120 as the liquid flow path 100. The supply flow path 110 includes the ink introduction port 111, the first flow path 112, the filter chamber 113 in which the filter 34 is provided, and the second flow path 114. In addition, the collection flow path 120 includes the discharge port 121.

In addition, the flow path member body 31 is provided with the retaining hole 36, which is a communication hole between the side of the filter chamber 113 that communicates with the second flow path 114 and the recessed portion 35. The retaining hole 36 is the detection region a having a low thermal resistance, which is sealed by a sealing member 37A having the thermal conductivity higher than that of the flow path member body 31.

In addition, the temperature detection unit 41 of the circuit substrate 40 is inserted into the retaining hole of the flow path member body 31 and the temperature detection unit 41 and the sealing member 37A (the detection region a) are arranged so as to face each other.

The sealing member 37A is constituted by a plate-like member and is fixed on the opening surface of the retaining hole 36 on the side of the supply flow path 110 (the filter chamber 113).

Furthermore, the sealing member 37A and the temperature detection unit 41 are connected via a pressing member 39, which presses the temperature detection unit 41 in a direction opposite to the sealing member 37A.

In the present exemplary embodiment, a plate spring is used as the pressing member 39. One end of the pressing member 39 including the plate spring is fixed to the sealing member 37A and the other end thereof is a free end. In addition, the other end, which is a free end, contacts the surface of the temperature detection unit 41 facing the sealing member 37A to press the temperature detection unit 41 in the direction opposite to the sealing member 37A.

Note that a conductive material, such as a metallic material, and an insulating material can be used for the pressing member 39. However, if a conductive material such as a metallic material is used as the pressing member 39 and if a thermistor is used as the temperature detection unit 41, the pressing member 39 can contact one electrode of the thermistor that is the temperature detection unit 41. Note that two electrodes of a thermistor are generally exposed to the surface thereof. Accordingly, if the conductive pressing member 39 simultaneously contacts both electrodes, a short circuit may occur on the two electrodes. In this case, the temperature cannot be correctly detected. Accordingly, if the conductive pressing member 39 is used, the pressing member 39 can be configured so that the pressing member 39 contacts one electrode of the thermistor that is the temperature detection unit 41 to suppress the short circuit occurring on the electrodes of the thermistor. With this configuration, the temperature can be normally measured. Of course, if the insulating material is used for the pressing member 39, no particular problem may occur if the pressing member 39 contacts both contacts of the thermistor. In addition, if a temperature sensor whose surface is covered with an insulating material, such as resin, i.e., a digital temperature sensor for example, is used as the temperature detection unit 41, no problem may occur if the pressing member 39 contacts either of the surfaces of the temperature detection unit 41 facing the sealing member 37A if a conductive material is used for the pressing member 39. Note that if the temperature sensor is used as the temperature detection unit 41 and if the contacts of the temperature sensor are exposed, the pressing member 39 can be configured so as not to contact the contacts of the temperature sensor and so as to contact the surface of the body of the temperature sensor and the like facing the sealing member 37A, which is covered with resin.

By providing the pressing member 39 between the sealing member 37A (the detection region a) and the temperature detection unit 41, the circuit substrate 40 is pressed in the direction opposite to the sealing member 37A. Note that because the circuit substrate 40 is pressed (biased) by the pressing portion 38 included in the second lid member 33 toward the sealing member 37A, it is preferable that the pressing force (biasing force) from the pressing member 39 for pressing the circuit substrate 40 toward the second lid member 33 be smaller than the pressing force (biasing force) from the pressing portion 38. With the above-described configuration, the circuit substrate 40 can be fixed at a position that is the closest to the sealing member 37A inside the recessed portion 35 of the flow path member body 31. As a result, the temperature of the detection region a can be measured by the temperature detection unit 41 with a high accuracy.

As described above, a material having a thermal conductivity higher than those of gas such as air and fluid such as grease and the like can be used for the pressing member 39, which is a contact between the sealing member 37A and the temperature detection unit 41. Accordingly, by using the pressing member 39 having the high thermal conductivity, the thermal resistance between the detection region a and the temperature detection unit 41 can be lowered compared to the case where the sealing member 37A and the temperature detection unit 41 contact each other via gas or fluid and the heat can be easily transmitted from the sealing member 37A (the detection region a) to the temperature detection unit 41. As a result, the actual temperature of the ink can be measured with a high accuracy and high responsiveness (i.e., with a high speed of response to an abrupt change of the ink temperature).

Furthermore, by providing the pressing member 39 between the sealing member 37A and the temperature detection unit 41, the sealing member 37A and the temperature detection unit 41 can securely contact each other via the pressing member 39 if the circuit substrate 40 is deviated from its fixing position or if the mounting height of the temperature detection unit 41 has varied. Note that if a contact member similar to the pressing member 39 contacts the temperature detection unit 41 but does not press the temperature detection unit 41 in the direction opposite to the sealing member 37A and if the fixing position of the circuit substrate 40 is slightly separated from the sealing member 37A, the sealing member 37A and the temperature detection unit 41 may not contact each other via the contact member. Similarly, if the mounting height of the temperature detection unit 41, which is mounted on the circuit substrate 40, has varied, the sealing member 37A and the temperature detection unit 41 may not contact each other via the contact member. In the present exemplary embodiment, by allowing the sealing member 37A and the temperature detection unit 41 to contact each other and by using the pressing member 39, which presses the temperature detection unit 41 in the direction opposite to the sealing member 37A, the sealing member 37A and the temperature detection unit 41 can securely contact each other via the pressing member 39 if the fixing position of the circuit substrate 40 is deviated or if the mounting height of the temperature detection unit 41 has varied. As a result, the temperature of the detection region a can be securely measured with a high accuracy.

In addition, a method that uses a heat transfer member, such as flexible wiring that connects between the detection region a and the temperature detection unit 41, instead of the pressing member 39 may be used. However, the method has a problem of requiring a complicated operation for connecting the heat transfer member to the sealing member 37A and the temperature detection unit 41. In the present exemplary embodiment, one end of the pressing member only is fixed to the sealing member 37A. Accordingly, the pressing member 39 can be mounted only by fixing the sealing member 37A to the flow path member body 31. With the above-described configuration, the operation for assembling the members can be simplified.

Figure 8A:
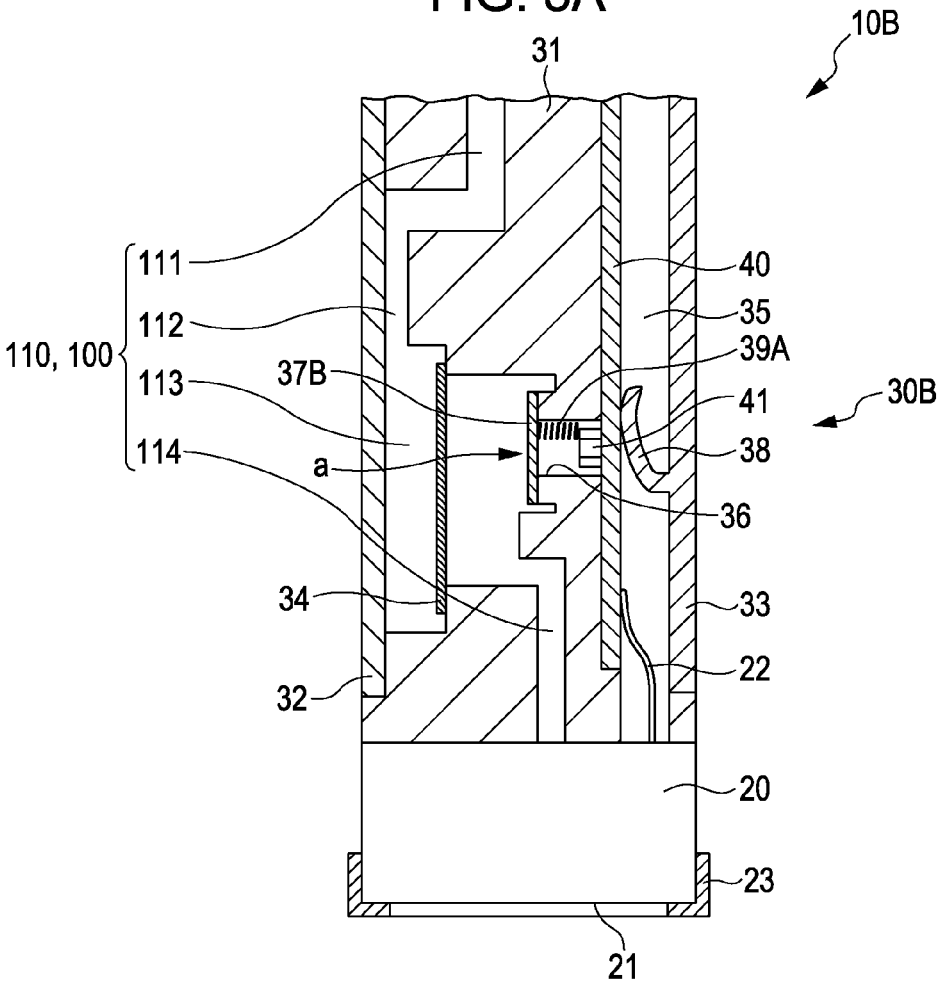
FIGS. 8A and 8B are cross sections illustrating main components of the recording head according to a modification of the third exemplary embodiment.
Figure 8B:
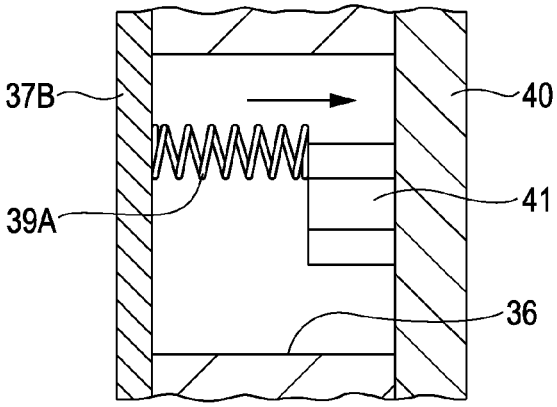

The pressing member 39 is not limited to the plate spring. Another example of the pressing member is illustrated in FIGS. 8A and 8B. Note that FIGS. 8A and 8B are cross sections illustrating main components of an ink jet type recording head, which is an example of a liquid ejecting head according to a modification of the third exemplary embodiment of the invention.

Referring to FIG. 8B, a pressing member 39A includes a compression coil spring. In addition, one end of the compression coil spring is fixed to the sealing member 37B and the other end thereof contacts the temperature detection unit 41. With this configuration, the pressing member 39A presses the temperature detection unit 41 in the direction opposite to the sealing member 37B.

The pressing member 39A including the above-described compression coil spring can be constituted by a conductive material or an insulating material, for example. However, if a thermistor is used as the temperature detection unit 41, the pressing member 39A can contact one contact of the thermistor, similarly to the above-described pressing member 39 including the plate spring.

Fourth Exemplary Embodiment

Figure 9A:
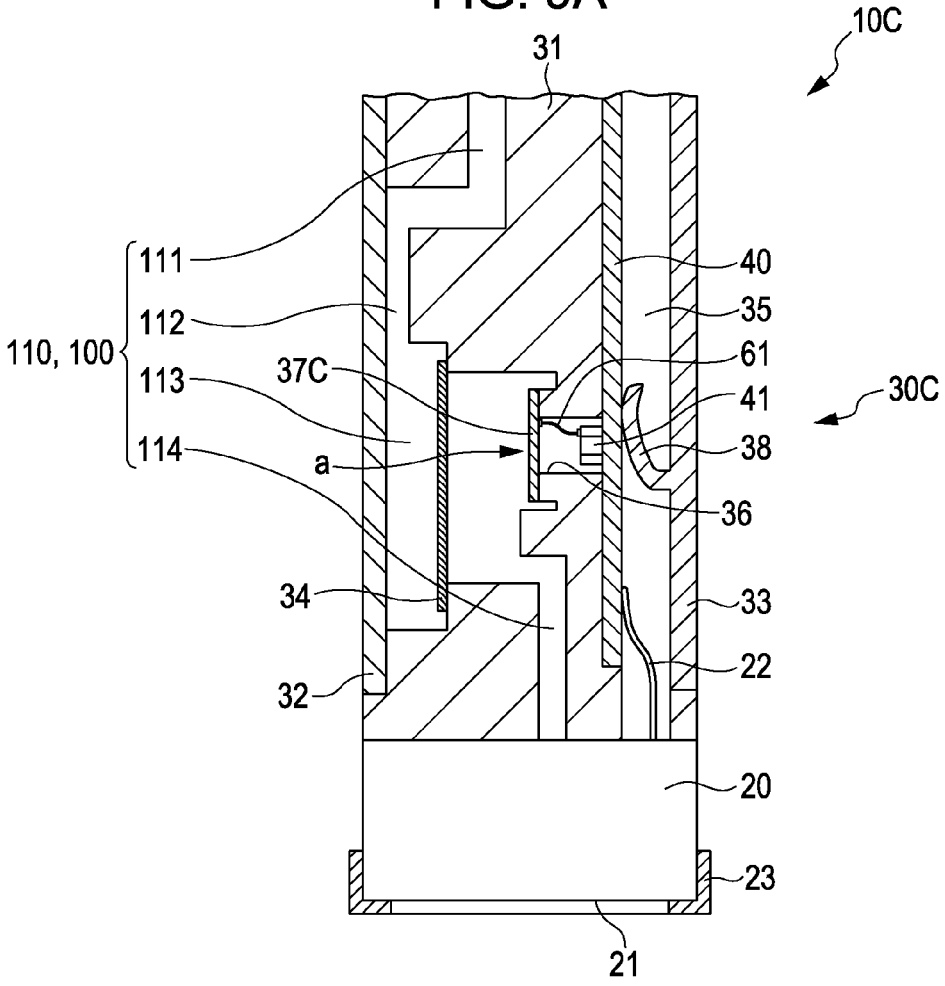
FIGS. 9A and 9B are cross sections illustrating main components of the recording head according to a fourth exemplary embodiment.
Figure 9B:
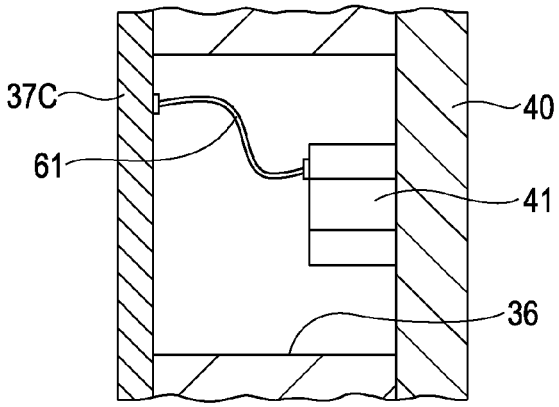

FIGS. 9A and 9B are cross sections illustrating main components of an ink jet type recording head, which is an example of a liquid ejecting head according to the fourth exemplary embodiment of the invention. Note that the same members as those of the exemplary embodiments described above are provided with the same reference signs. Accordingly, the detailed description thereof will not be repeated here.

Referring to FIG. 9A, an ink jet type recording head 10C according to the present exemplary embodiment includes the head body 20, a flow path member 30C, the circuit substrate 40, and the wiring substrate 50.

The flow path member 30C includes the flow path member body 31, the first lid member 32, and the second lid member 33. The circuit substrate 40 is held between the flow path member body 31 and the second lid member 33.

The flow path member 30C includes the supply flow path 110 and the collection flow path 120 as the liquid flow path 100. The supply flow path 110 includes the ink introduction port 111, the first flow path 112, the filter chamber 113 in which the filter 34 is provided, and the second flow path 114. In addition, the collection flow path 120 includes the discharge port 121.

In addition, the flow path member body 31 is provided with the retaining hole 36, which is a communication hole between the side of the filter chamber 113 that communicates with the second flow path 114 and the recessed portion 35. The retaining hole 36 is the detection region a, which is sealed by a sealing member 37C having the thermal conductivity higher than that of the flow path member body 31.

In addition, the temperature detection unit 41 of the circuit substrate 40 is inserted into the retaining hole of the flow path member body 31 and the temperature detection unit 41 and the sealing member 37C (the detection region a) are arranged so as to face each other.

The sealing member 37C is constituted by a plate-like member and is fixed on the opening surface of the retaining hole 36 on the side of the supply flow path 110 (the filter chamber 113).

Furthermore, the sealing member 37C and the temperature detection unit 41 are connected via a heat transfer member 61. For the heat transfer member 61, conductive flexible wiring can be used, for example.

Note that if a conductive material is used for the heat transfer member 61 and if a thermistor is used as the temperature detection unit 41, the heat transfer member 61 can be connected to one electrode of the thermistor that is the temperature detection unit 41. Note that two electrodes of a thermistor are generally exposed to the surface thereof. Accordingly, if the conductive heat transfer member 61 simultaneously contacts both electrodes, a short circuit may occur on the two electrodes. In this case, the temperature cannot be correctly detected. Accordingly, if the conductive heat transfer member 61 is used, the heat transfer member 61 can be configured so that the heat transfer member 61 contacts one electrode of the thermistor that is the temperature detection unit 41 to suppress the short circuit occurring on the electrodes of the thermistor. Of course, if the insulating material is used for the heat transfer member 61, no particular problem may occur if the heat transfer member 61 contacts both contacts of the thermistor. In addition, if a temperature sensor whose surface is covered with an insulating material, such as resin, i.e., a digital temperature sensor for example, is used as the temperature detection unit 41, no particular problem may occur if the heat transfer member 61 contacts either of the surfaces of the temperature detection unit 41 other than the exposed contacts thereof if a conductive material is used for the heat transfer member 61.

In addition, it is preferable that the heat transfer member 61 longer than the distance between the sealing member 37C and the temperature detection unit 41 be used. With the above-described configuration, the heat transfer member 61 can be easily fixed to both the sealing member 37C and the temperature detection unit 41. As a result, the members can be easily assembled together.

As described above, it is preferable that a material having a thermal conductivity higher than those of gas such as air and fluid such as grease be used for the heat transfer member 61 which connects between the sealing member 37C and the temperature detection unit 41. Accordingly, by using the heat transfer member 61 having the high thermal conductivity, the thermal resistance between the sealing member 37C (the detection region a) and the temperature detection unit 41 can be lowered and the heat can be easily transferred from the sealing member 37C to the temperature detection unit 41 compared to a case where the sealing member 37C and the temperature detection unit 41 contact each other via fluids. With the above-described configuration, the actual temperature of the ink can be measured with a high accuracy and high responsiveness (i.e., with a high speed of response to an abrupt change of the ink temperature). In addition, by using the heat transfer member 61, a contact failure, which may occur if fluids such as grease has flown out toward the circuit substrate 40, can be easily suppressed compared to a case of using fluids such as grease although a complicated operation for connecting the heat transfer member 61 to the sealing member 37C and the temperature detection unit 41 is required in the case of using the heat transfer member 61.

In addition, by using the heat transfer member 61 that is longer than the distance between the sealing member 37C and the temperature detection unit 41, the members can be easily assembled together and the sealing member 37C and the temperature detection unit 41 can securely contact each other if the circuit substrate 40 is deviated from its fixing position or if the mounting height of the temperature detection unit 41 has varied.

Other Exemplary Embodiments

Exemplary embodiments of the invention are as described above. However, the basic constitution of the embodiments of the invention is not limited to that described above. For example, in each of the above-described exemplary embodiments, the detection region a is provided on the partition wall of the filter chamber 113 on the side on which the filter chamber 113 communicates with the second flow path 114. However, the location of providing the detection region a is not limited to this. For example, the detection region a can be provided on the partition wall of the filter chamber 113 upstream of the filter 34, i.e., on the partition wall of the filter chamber 113 on which the filter chamber 113 communicates with the first flow path 112. In this case, the ink measured with respect to the detection region a may become distant from the head body 20 compared to each of the above-described exemplary embodiments. Accordingly, the error between the temperature of the ink to be actually discharged and the measured temperature may become greater than that of each exemplary embodiment described above. However, if any foreign matter, such as an adhesive for fixing the sealing member 37, 37A, 37B, or 37C, has been mixed into the ink, the contaminant can be captured by the filter 34. Accordingly, the above-described configuration can exert an effect of preventing poor discharge of ink, which may occur due to clogged nozzle openings. Of course, the detection region a can be provided on the partition wall that partitions the first flow path 112 and the second flow path 114. However, in this case, the size of the ink jet type recording head 10, 10A, 10B, and 10C may become large because a space for the retaining hole 36, that is, an ink pool is required. In each of the above-described exemplary embodiments, the filter chamber 113 is previously formed with a great width to secure an effective area of the filter 34. Accordingly, by providing the detection region a on the partition wall that partitions the filter chamber 113, it becomes unnecessary to separately provide the space for providing the detection region a. As a result, the size of the ink jet type recording heads 10, 10A, 10B, and 10C can be designed to be small. Of course, the detection region a can be provided on the side of the collection flow path 120. Note that if the detection region a can be provided on the side of the collection flow path 120, the temperature of the ink before it is discharged cannot be measured. However, no particular problem may arise in this case because the ink in the ink jet type recording head 10 is circulated.

In addition, in each of the exemplary embodiments described above, the detection region a is constituted by the retaining hole 36 and the sealing member 37, 37A, 37B, or 37C that seals the retaining hole 36. However, the configuration of the detection region a is not limited to this. For example, a part of the region of the partition wall of the flow path member body 31 that partitions the liquid flow path 100 can be configured to be thin and the thin region can be used as the detection region a. More specifically, if the detection region a of the embodiments of the invention can be provided either integrally with the flow path member 30, 30A, 30A, or 30C or separately therefrom as long as the detection region a has a thermal resistance lower than that of other regions. In other words, because the thermal resistance is defined by the following expression:

$$\text{thickness}/(\text{thermal conductivity}\times\text{area}),$$

the thermal resistance can be lowered by using a less thick material even if the same material is used or by using a different material having a high thermal conductivity.

Note that if the detection region a is provided in a thin part of the partition wall of the flow path member body 31 that partitions the liquid flow path 100 and if a material having a high thermal conductivity, such as a metallic material, is used as the material of the flow path member body 31, the temperature of the ink to be actually discharged can be measured by the temperature detection unit 41 with a higher accuracy and higher responsiveness.

In addition, in each of the exemplary embodiments described above, the detection region a and the temperature detection unit 41 contact each other via gas such as air or fluid such as grease or via the pressing member 39 (or 39A) or the heat transfer member 61. However, the configuration of the embodiments of the invention is not limited to this. More specifically, the detection region a and the temperature detection unit 41 can directly contact each other. However, if the members forming the detection region a, i.e., the sealing member 37, 37A, 37B, and 37C, the flow path member body 31, and the like, for example, are conductive, the temperature sensor covered with the insulating material can be used as the temperature detection unit 41 instead of using the thermistor. Note that considering possible variation of the mounting height of the temperature detection unit 41 and any possible dimension error that may occur on the flow path member body 31 if the flow path member body 31 is manufactured by relatively inexpensive components, it is difficult to always manufacture the apparatus so that the temperature detection unit 41 and the detection region a directly contact each other. However, the detection region a and the temperature detection unit 41 can securely contact each other even if the mounting height of the temperature detection unit 41 has varied or if any dimension error has occurred by allowing the detection region a and the temperature detection unit 41 to contact each other via the fluid such as grease or via the pressing member 39 (or 39A) or the heat transfer member 61 as described above in the exemplary embodiments.

Figure 10:
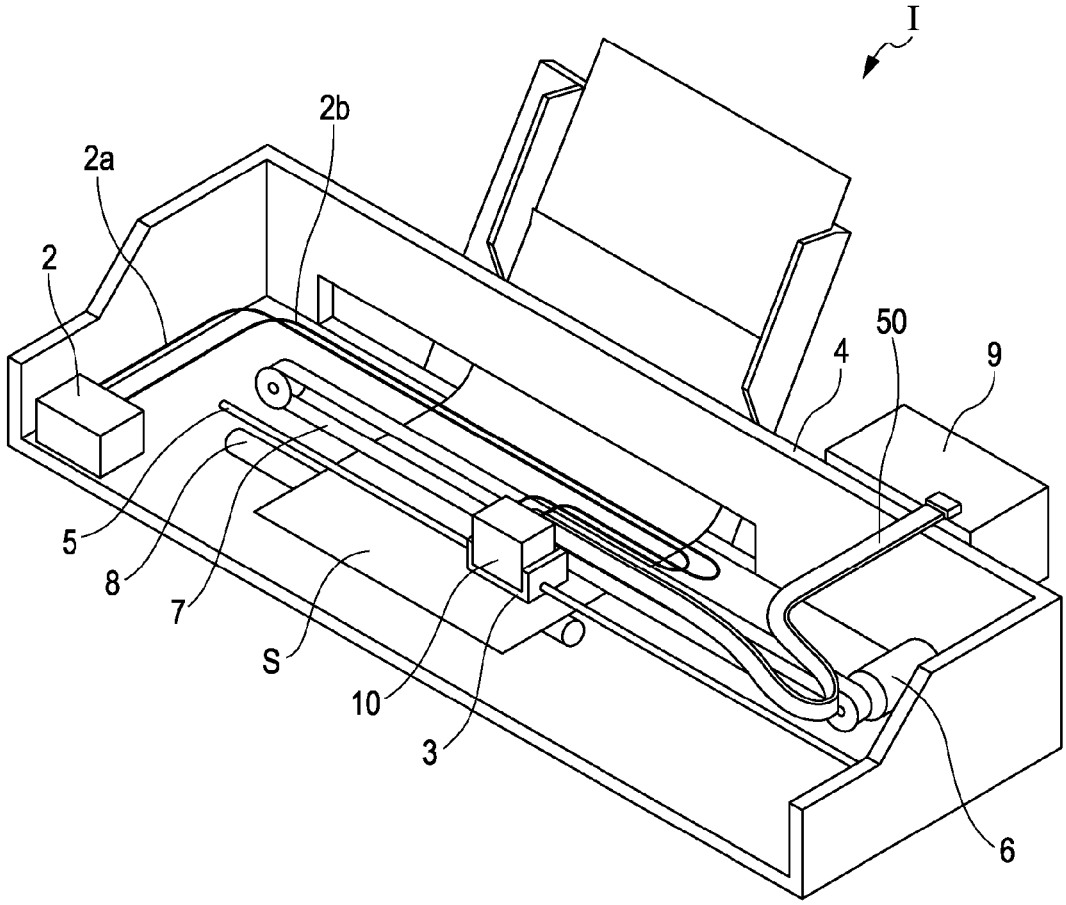
FIG. 10 is an outline perspective view illustrating a recording apparatus according to an embodiment of the invention.

In addition, the ink jet type recording head according to each of the above-described exemplary embodiments is installed in a liquid ejecting apparatus, which is an example of an ink jet type recording apparatus. Hereinbelow, an ink jet type recording apparatus according to an exemplary embodiment will be described. FIG. 10 is an outline perspective view illustrating the ink jet type recording apparatus, which is an example of the liquid ejecting apparatus according to an exemplary embodiment of the invention.

Referring to FIG. 10, an ink jet type recording apparatus I includes a carriage 3 to which the ink jet type recording head 10 is installed. The carriage 3 is movably provided on the carriage axis 5, which is attached to an apparatus body 4, in the axial direction.

In addition, by transmitting the drive force from a drive motor 6 to the carriage 3 via a plurality of gears (not illustrated) and a timing belt 7, the carriage 3, in which the ink jet type recording head 10 is installed, moves along the carriage axis 5. On the other hand, the apparatus body 4 includes a platen 8 provided along the carriage axis 5. A recording sheet S, which is a recording medium such as paper, which is fed from a feed roller (not illustrated), is wound around the platen 8 to be transported.

In addition, the ink jet type recording apparatus I includes a liquid storage portion 2, such as an ink tank, which is fixed to the apparatus body 4 and which stores the ink in its inside. A supply tube 2*a* for supplying the ink to the ink jet type recording head 10 and a collection tube 2*b* for collecting the ink from the ink jet type recording head 10 are connected to the liquid storage portion 2.

The supply tube 2*a* and the collection tube 2*b* is constituted by a tubular member, such as a flexible tube and respectively include a supply path for supplying the ink and a collection path for collecting the ink in the inside thereof. Furthermore, one end of the supply tube 2*a* (the supply path) is connected to the ink introduction port 111 of the supply flow path 110 of the ink jet type recording head 10 and one end of the collection tube 2*b* (the collection path) is connected to the discharge port 121 of the collection flow path 120. With this configuration, the ink is supplied from the liquid storage portion 2 to the ink jet type recording head 10 and the ink is collected from the ink jet type recording head 10 to the liquid storage portion 2.

Note that although not illustrated in the drawing, a pumping unit, such as a pressure pump or a suction pump, is provided in the middle of the supply tube 2*a* or the collection tube 2*b*. The ink is circulated between the liquid storage portion 2 and the ink jet type recording head 10 by the pumping by the pumping unit.

In addition, the ink jet type recording apparatus I includes a control device 9 configured to control the operation of the ink jet type recording apparatus I. the control device 9 and the ink jet type recording head 10 are mutually connected via the wiring substrate 50.

Note that in the example illustrated in FIG. 10, the ink jet type recording head 10 is installed in the carriage 3 and the carriage 3 moves in the main scanning direction. However, the present exemplary embodiment is not particularly limited to this. For example, the embodiment of the invention can be applied to a recording apparatus known as a line-type recording apparatus, in which the ink jet type recording head 10 is fixed and which executes printing by merely moving a recording sheet S, such as paper, in the sub scanning direction.

Moreover, in the above-described exemplary embodiments, the ink jet type recording heads 10, 10A, the ink jet type recording head 10A, and 10C in which the ink is supplied from the liquid storage portion 2 to the ink jet type recording head 10 and the ink is collected to the liquid storage portion 2 are described. However, the embodiment of the invention is not particularly limited to this. More specifically, the embodiment of the invention can be applied to an ink jet type recording head that merely supplies the ink from the liquid storage portion 2 to the ink jet type recording head 10.

Note that in the above-described exemplary embodiment, the ink jet type recording head is described as an example of the liquid ejecting head. However, the embodiment of the invention is intended largely to various types of liquid ejecting heads. Accordingly, the embodiment of the invention can of course be applied to a liquid ejecting head that ejects liquid other than ink. Such other liquid ejecting heads include various types of recording heads used in an image recording apparatus such as a printer, a color material ejection head used in manufacturing a color filter for a liquid crystal display (LCD) and the like, an electrode material ejection head used in forming an electrode for a display, such as an organic electroluminescent (EL) display, a field emission display (FED), and the like, a bioorganic matter ejection head used in manufacturing a biochip, and the like.

The entire disclosures of Japanese Patent Application Nos. 2012-022548, filed Feb. 3, 2012 and No. 2012-227706, filed Oct. 15, 2012 are incorporated by reference herein.

What is claimed is:

1. A liquid ejecting head comprising:

a head body configured to eject liquid;

a flow path member including:

a liquid flow path for supplying the liquid to the head body;

a filter that is provided in the liquid flow path to remove foreign objects in the liquid; and a detection region that has a thermal resistance lower than a thermal resistance of the remainder of the flow path member and that is provided in a part of a partition wall that partitions the liquid flow path; and a circuit substrate held by the flow path member and including a temperature detection unit configured to detect a temperature, wherein the circuit substrate is fixed to the flow path member in a state in which the temperature detection unit faces the detection region, and the detection region is provided downstream of the filter with respect to a liquid flowing direction in the liquid flow path.

2. The liquid ejecting head according to claim 1, wherein the flow path member includes a retaining hole which communicates with the liquid flow path and which penetrates to a side of the circuit substrate, wherein the retaining hole is sealed by a sealing member having a thermal conductivity higher than a thermal conductivity of the remainder of the flow path member, and wherein a region in which the sealing member seals the retaining hole is the detection region.

3. The liquid ejecting head according to claim 1, wherein the temperature detection unit and the detection region are connected via a fluid.

4. The liquid ejecting head according to claim 3, wherein the fluid is a filler having a thermal conductivity higher than a thermal conductivity of a gas.

5. The liquid ejecting head according to claim 1, wherein the temperature detection unit and the detection region directly contact each other.

6. The liquid ejecting head according to claim 1, wherein the circuit substrate is fixed in a state in which the circuit substrate is pressed toward the detection region.

7. A liquid ejecting apparatus comprising the liquid ejecting head according to claim 1.

8. A liquid ejecting head comprising:

a head body configured to eject liquid;

a flow path member including:

a liquid flow path for supplying the liquid to the head body; and a detection region that has a thermal resistance lower than a thermal resistance of the remainder of the flow path member and that is provided in a part of a partition wall that partitions the liquid flow path, the detection region having a metal sealing plate that isolates an inner space of the detection region from an inner space of the liquid flow path so as to prevent the liquid from entering into the inner space of the detection region; and a circuit substrate held by the flow path member and including a temperature detection unit configured to detect a temperature, wherein the circuit substrate is fixed to the flow path member in a state in which the temperature detection unit faces the detection region, and the temperature detection unit is spaced apart from the metal sealing plate by air.

9. The liquid ejecting head according to claim 8, wherein the flow path member has a filter that is provided in the liquid flow path to remove foreign objects in the liquid, and the detection region is provided downstream of the filter with respect to a liquid flowing direction in the liquid flow path.

10. The liquid ejecting head according to claim 8, wherein the circuit substrate is fixed in a state in which the circuit substrate is pressed toward the detection region.

11. A liquid ejecting apparatus comprising the liquid ejecting head according to claim 8.

12. A liquid ejecting head comprising:

a head body configured to eject liquid;

a flow path member including:

a liquid flow path for supplying the liquid to the head body;

a filter that is provided in the liquid flow path to remove foreign objects in the liquid; and a detection region that has a thermal resistance lower than a thermal resistance of the remainder of the flow path member and that is provided in a part of a partition wall that partitions the liquid flow path, the detection region having a metal sealing plate that isolates an inner space of the detection region from an inner space of the liquid flow path so as to prevent the liquid from entering into the inner space of the detection region; and a circuit substrate held by the flow path member and including a temperature detection unit configured to detect a temperature, wherein the circuit substrate is fixed to the flow path member in a state in which the temperature detection unit faces the detection region, the detection region is provided downstream of the filter with respect to a liquid flowing direction in the flow path member, and the temperature detection unit is spaced apart from the metal sealing plate by a fluid that is different from the liquid.

13. The liquid ejecting head according to claim 12, wherein the circuit substrate is fixed in a state in which the circuit substrate is pressed toward the detection region.

14. A liquid ejecting apparatus comprising the liquid ejecting head according to claim 12.

* * * * *